United States Patent [19]

Kast

[11] 4,276,809

[45] Jul. 7, 1981

[54] SIMPLIFIED FAIL-FIXED SERVOVALVE

[75] Inventor: Howard B. Kast, Fairfield, Ohio

[73] Assignee: General Electric Company, Cincinnati, Ohio

[21] Appl. No.: 32,577

[22] Filed: Apr. 23, 1979

[51] Int. Cl.[3] ..... F15B 15/17; F15B 13/044

[52] U.S. Cl. ..... 91/417 R; 91/3; 91/459; 91/461

[58] Field of Search ..... 91/417 R, 3, 461, 459

[56] References Cited

U.S. PATENT DOCUMENTS

| | | | |
|---|---|---|---|
| 3,473,547 | 10/1969 | Coakley | 137/83 |
| 3,592,211 | 7/1971 | Spalding | 137/83 |
| 3,863,547 | 2/1975 | Meier et al. | 91/417 R |
| 3,922,955 | 12/1975 | Kast | 91/461 |
| 3,969,985 | 7/1976 | Grieger et al. | 91/417 R |

*Primary Examiner*—Paul E. Maslousky

*Attorney, Agent, or Firm*—Carl L. Silverman; Derek P. Lawrence

[57] ABSTRACT

A simplified fail-fixed electrohydraulic servovalve for operating with a source of fluid under pressure, and a piston translatably disposed within a bore. The piston has a rod side face area which is less than its head side face area and translates in a first direction for electrical input signals above a first predetermined percent of a maximum rated input signal. At a second percent of the rated input signal, determined by the ratio of the piston rod side face area to the piston head side face area, the piston position is fixed. For electrical input signals greater than the second percent of the rated input signal the piston translates in the second direction. Any input signal below the first percent causes the piston to be fixed in place.

3 Claims, 3 Drawing Figures

SIMPLIFIED FAIL-FIXED SERVOVALVE

BACKGROUND OF THE INVENTION

1. Field of the Invention

This invention relates to a fail-fixed servovalve and, more particularly, to an improved, simplified fail-fixed servovalve which is particularly suitable for use in conjunction with a pulse width modulated digital driving signal.

2. Description of the Prior Art

Servovalves of the electrohydraulic type have been widely used as an interface between electrical control systems and different types of mechanical or hydraulic metering or actuating devices. For example, in a gas turbine engine fuel control system, an electrical control signal generated by an electronic fuel control computer may be applied to the input of a servovalve. In response to the electrical input signal, the servovalve controls the movement of a servopiston which translates within a bore to generate a mechanical output signal for varying the position of a mechanical fuel metering valve. Thus, the flow of fuel to the gas turbine engine can be accurately controlled as a function of the computer generated electrical signal.

Due to the widespread use of such servovalves in particularly critical control systems, such as the above-described gas turbine engine fuel control system, it is desirable for the servovalve to be fail-fixed. By fail-fixed, it is meant that the mechanical output of the servovalve is zero (i.e., the servopiston is locked in position) in the event the electrical input signal is either lost or exceeds a rated maximum value. An example of such a fail-fixed servovalve is described in U.S. Pat. No. 3,922,955, assigned to the assignee of the present invention.

The prior art fail-fixed servovalve described in the aforementioned U.S. Patent operates utilizing bi-polar input currents; that is, the servopiston moves in one direction when positive current is applied to the servovalve input and moves in the opposite direction when negative current is applied to the servovalve input. For zero or null current and for a surrounding deadband region on both the positive and negative sides of zero current, the servopiston is essentially locked in position (fixed) with slight movements due to fluid leakage. Although this type of fail-fixed servovalve has proven to be adequate for many applications, the inherent deadband at null requires a complex driver circuit with deadband compensation.

The prior art fail-fixed servovalve is also relatively expensive to produce and the use of a contamination sensitive second stage spool makes it more expensive to operate due to the need for additional fluid filtration.

It is, therefore, an object of the present invention to provide an improved, simplified fail-fixed servovalve which is compatible with pulse width modulated digital driving signals.

It is another object of the present invention to provide such fail-fixed servovalve which is simple to operate and relatively inexpensive to produce.

It is a further object of the present invention to provide such a fail-fixed servovalve which does not require additional deadband compensation circuitry.

It is yet another object of the present invention to provide such a fail-fixed servovalve which is less sensitive to fluid contamination.

SUMMARY OF THE INVENTION

Briefly stated, these objects, as well as additional objects and advantages, which will become apparent from the following description and the appended drawings and claims, are accomplished by the present invention which provides a fail-fixed servovalve for operation with a source of fluid under a supply pressure.

A fail-fixed electrohydraulic servovalve is provided for use with a piston translatably disposed within a bore. The servovalve includes means for maintaining the piston in a fixed position for electrical input signals which are less than a first predetermined percent of a maximum rated electrical input signal and for causing the piston to translate in a first electrical input signal and for causing the piston to translate in a first direction for electrical input signals which are greater than the first percent but less than a second predetermined percent of the maximum rated electrical input signal. The means maintains the piston in a fixed position for electrical input signals which are equal to the second percent of the maximum rated electrical input signal and causes the piston to translate in the second direction for electrical input signals which are greater than the second percent of the maximum rated electrical input signal.

The servovalve is for use with a piston having a rod side face area which is less than the head side face area. The piston is translatably disposed within a bore and a first conduit is connected to deliver fluid at the supply pressure, to the rod side of the piston. A second conduit is connected to deliver fluid to the head side of the piston and means, responsive to an electrical input signal, is provided to control the fluid flowing through the second conduit. The means blocks the second conduit when the electrical signal is less than or equal to a predetermined percent of a maximum rated electrical input signal and allows fluid to flow through the second conduit as the magnitude of the electrical input signal is increased from the predetermined percent to one hundred percent of the maximum rated electrical input signal. The fluid pressure on the head side of the piston when locked correspondingly increases from the predetermined percent to one hundred percent of the supply pressure.

DESCRIPTION OF THE PREFERRED EMBODIMENT

Figure 1:
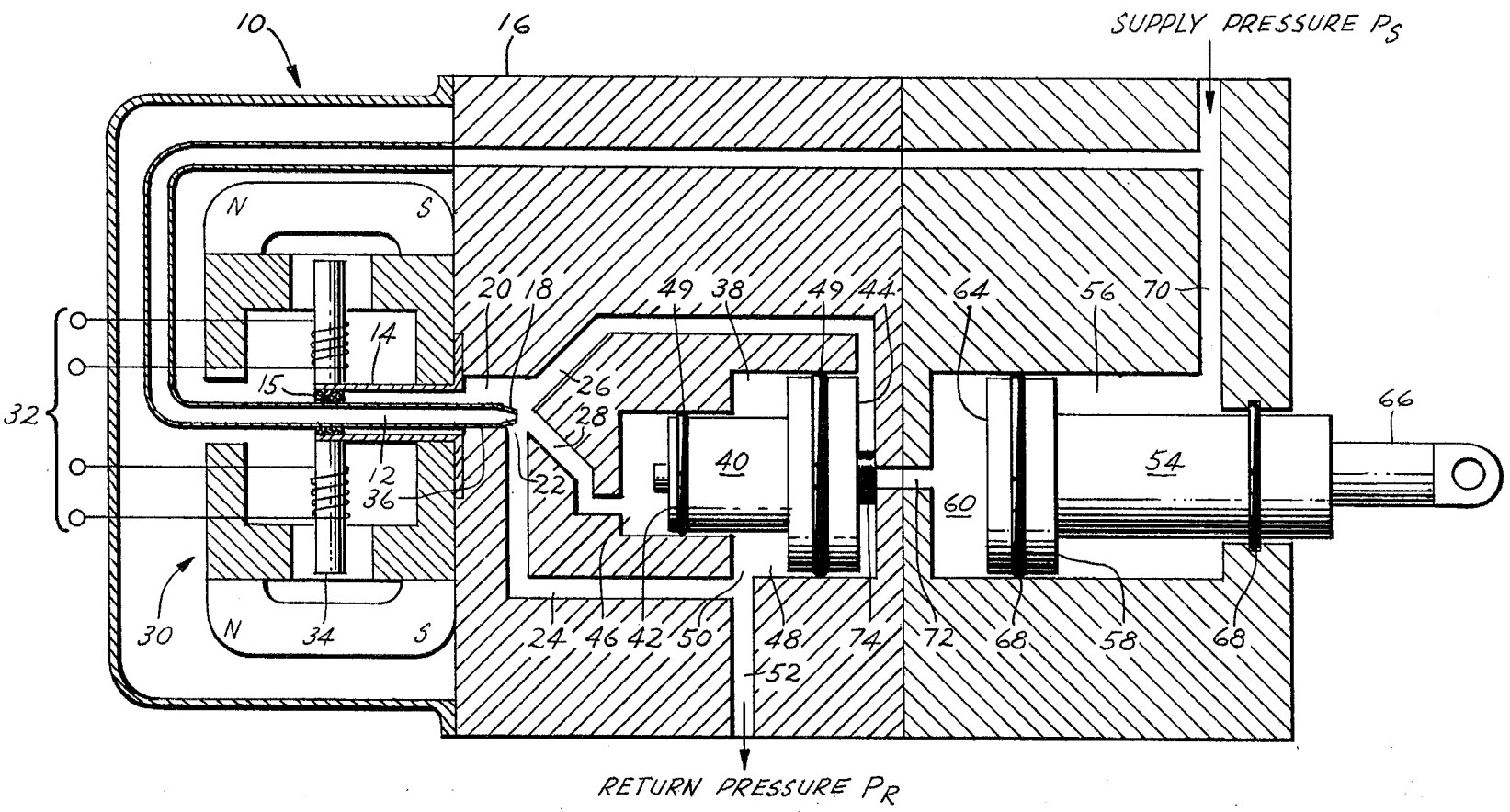
FIG. 1 is a cross-sectional view of the simplified fail-fixed servovalve of the present invention.

Referring now to FIG. 1, there is depicted, in one form, the improved fail-fixed servovalve of the present invention which is shown generally as 10. The servovalve 10 is comprised of a flexible jet pipe 12 and a flexible tube 14 which are mounted in a housing 16. The jet pipe 12 receives a flow of fluid, which may be any suitable servo or hydraulic fluid, from a fluid source (not shown). The fluid flowing from the fluid source is either at a constant or varying supply pressure, hereinafter referred to as $P_S$.

The pressurized fluid flowing through the jet pipe 12 is dicharged through a relatively small area nozzle 18 into a chamber 20. The chamber has a fluid return outlet 22 which is connected by way of a return conduit 24 to a low pressure fluid sump (not shown). The pressure drop across the nozzle 18 causes the discharge of a high velocity jet of fluid to enter the chamber 20. A pair of receiver conduits 26 and 28 is disposed within the housing 16 to receive the jet pipe fluid. A deflecting means 30, shown in this embodiment as a torque motor, is provided for altering the position of the jet pipe 12 in response to an electrical input signal received through a plurality of electrical lines or wires (collectively designated as 32). An armature 34 of the torque motor 30 is secured to the flexible tube 14 and exerts a bending movement thereon when an electrical current is applied to the wires 32. The flexible tube 14 exerts a resisting moment, thereby causing a bending displacement which is directly proportional to the magnitude of the electrical current applied to the wires 32. The jet pipe 12 is bonded at 15, such as by bonding or brazing, to the inside of the flexible tube 14 and follows the bending displacement.

The receiver conduits 26 and 28 are connected to opposite ends of a chamber 38 within which is translatably disposed a shuttle piston 40. In this embodiment, the shuttle piston 40 is constructed in such a predetermined manner that the piston face area ($\frac{1}{3}$ $A_1$) on its left side 42 (as viewed on FIG. 1) is one-third the size of the piston face area ($A_1$) on its right side 44. The shuttle piston chamber 38 is correspondingly formed so that the area of the left end 46 is one-third the size of the area of the right end 48. O-ring seals 49 may be provided as shown to prevent fluid leakage. A fluid return outlet 50 in the shuttle piston chamber 38 is connected by way of a return conduit 52 to the fluid sump (not shown).

A servopiston 54 is translatably disposed within a bore or chamber 56 in the housing 16. In this embodiment, the servopiston 54 is constructed in such a predetermined manner that its rod side 58 has a piston face area (0.6 $A_2$) which is substantially sixty percent of the piston face area ($A_2$) of its head side 64. Extending from the servopiston 54 is a connecting rod 66, which may be connected to a metering or actuation device (not shown). O-ring seals 68 may be provided as shown to prevent fluid leakage. The rod side of the servopiston chamber 56 is connected to the fluid source (not shown) by a conduit 70. The head side of the servopiston chamber 60 is connected by a conduit 72 to the right end of the shuttle piston chamber 48.

As is shown in FIG. 1, the jet pipe 12 is in the undeflected or zero current position. In the undeflected position, the jet pipe 12 abuts a stop 36 and all of the pressurized fluid flowing through the jet pipe 12 is discharged through the nozzle 18 and into receiver conduit 28. As a result, the pressure on the shuttle piston left side 42 is essentially equal to $P_S$. Since the pressure on the shuttle piston right side 44 is essentially equal to the return pressure (hereinafter referred to as $P_R$) the shuttle piston 40 is forced all the way to the right end of the shuttle chamber 38. A soft seat seal 74 on the shuttle piston right side 44 engages the right side wall of the shuttle piston chamber 38 and effectively blocks the flow of any fluid through conduit 72, thereby hydraulically locking the servopiston 54 in place.

As the magnitude of the input current to the torque motor 30 is increased in the positive direction, the deflecting force of the torque motor 30 correspondingly increases and the jet pipe 12 is deflected proportionally upward (as viewed in FIG. 1). With the upward deflection of the jet pipe 12, a portion of the pressurized fluid flowing through the jet pipe nozzle 18 is discharged into receiver conduit 26, and leff fluid is discharged into receiver conduit 28. Thus, the pressure on the shuttle piston left side face 42 is decreased as the pressure on the shuttle piston right side face 44 is increased.

When the torque motor input current is increased to a value as a percent of the maximum positive rated torque motor input current (hereinafter referenced to as rated current), for example twenty-five percent (25%), the jet pipe 12 is deflected one-fourth of its maximum possible deflection. At this position, recovered pressure in receiver conduit 26 (0.25 $P_S$) is one-third of that in receiver conduit 28 (0.75 $P_S$). Since the face area of the shuttle piston left side 42 is one-third the size of the face area of the shuttle piston right side 44, the forces acting upon both sides of the shuttle piston 40 are balanced ($0.25P_SXA_1=0.75P_SX\frac{1}{3}A_1$) and the shuttle piston 40 is maintained in the position as shown in FIG. 1. The servopiston 54 is still hydraulically locked in place.

When the torque motor input current slightly exceeds the predetermined twenty-five percent of the rated current, the jet pipe 12 is deflected more than one-fourth of its maximum deflection and the recovered pressure in receiver conduit 26 (slightly greater than $0.25P_S$) is greater than one-third of that in receiver conduit 28 (slightly less than $0.75P_S$). As a result, the force acting upon the shuttle piston right side 44 is greater than that acting upon the shuttle piston left side 42 and the shuttle piston 40 strokes all the way to the left of the chamber 38. The shuttle piston 40 remains against the left wall of the chamber 38 for all torque motor input currents which exceed the predetermined (twenty-five) percent of rated current.

As the shuttle piston 40 strokes to the left, the seal 74 becomes disengaged from the right side wall of the shuttle piston chamber 38 thereby allowing fluid to flow through conduit 72. The fluid flowing through receiver conduit 26 (slightly greater than $0.25P_S$) also flows through conduit 72. Since the force acting upon the servopiston head side 64 (for example slightly greater than $0.25P_SXA_2$) is less than the force acting upon the servopiston rod side 58 ($P_SX0.6A_2$) the servopiston 54 moves to the left.

As the magnitude of the torque motor input current is increased from slightly exceeding twenty-five percent to one hundred percent of rated current, the amount of fluid which flows into receiver conduit 26 and through conduit 72 causes the fluid pressure on the servopiston head side 64 to correspondingly increase from slightly greater than $0.25P_S$ to $P_S$.

In this embodiment, when the magnitude of the torque motor input current is sixty percent of rated current, the recovered pressure in receiver conduit 26 and in conduit 72 is $0.6P_S$. At this point, the forces acting upon both sides of the servopiston 54 are balanced ($0.6P_SXA_2=P_SX0.6A_2$) and the servopiston 54 stops. Any increase in the torque motor input current beyond sixty percent of rated current increases the recovered pressure in receiver conduit 26 and in conduit 72 to greater than $0.6P_S$. Thus, the force acting upon the servopiston head side 64 (greater than $0.6P_SXA_2$) exceeds the force acting upon the servopiston rod side 58 ($P_SX0.6A_2$) and the servopiston 54 moves to the right.

Figure 2:
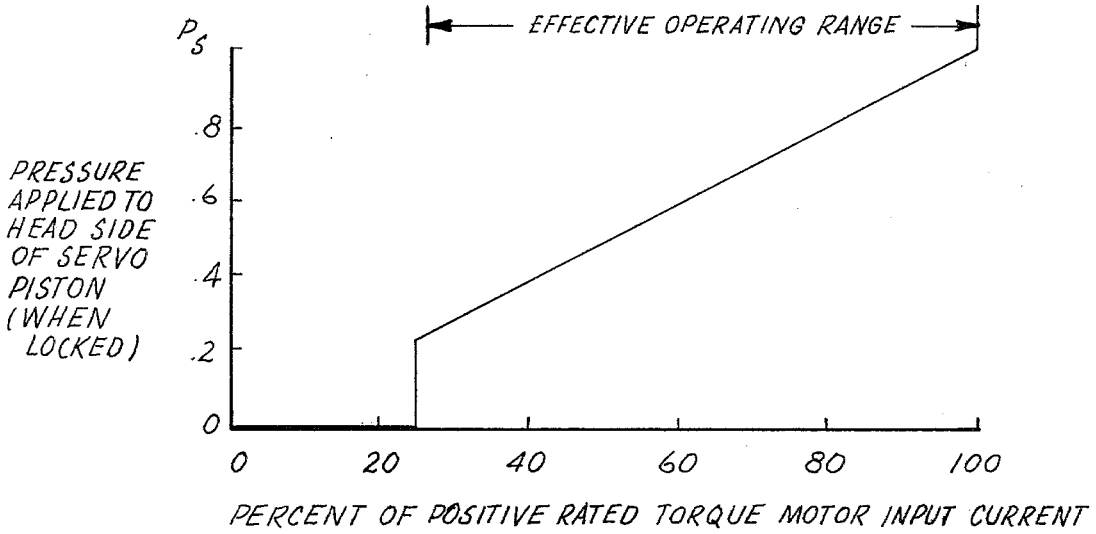
FIG. 2 is a graphical representation of the pressure applied to the head side of the servopiston of FIG. 1, when locked, as a function of the input current.
Figure 3:
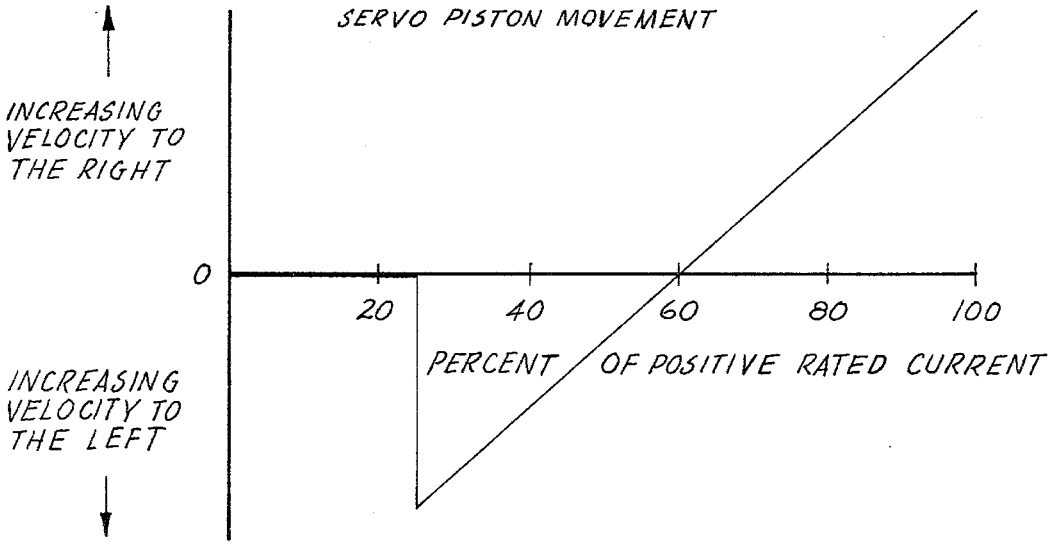
FIG. 3 is a graphical representation of the servopiston velocity as a function of the input current.

As shown in FIGS. 2 and 3, the effective operating range of the servovalve 10 is from the predetermined percent, in this embodiment twenty-five percent, to one hundred percent of positive rated torque motor input current with a null, where the servopiston 54 is stationary, at sixty percent of rated current. The location of the null is determined by the area ratio of the head to rod sides of the servopiston 54 and accordingly may be varied for specific applications. One advantage to this type of servovalve is that unlike the previously described prior art fail-fixed servovalve the soft seat seal 74 makes the fail-fixed action absolute so there is no servopiston creep. There is also no surrounding deadband region at null so additional compensation circuitry is unnecessary.

Throughout the effective operating range of the servovalve 10 the shuttle piston 40 remains at the left side of the shuttle piston chamber 38 and does not affect the action of the servopiston 54. In the event that the torque motor input current drops below the predetermined twenty-five percent of rated current, the shuttle piston 40 strokes all the way to the right of the shuttle piston chamber 38, thereby causing the seal 74 to block the flow of fluid through conduit 72 and locking the servopiston 54 in place.

This servovalve protects a control system in regard to most types of electrical control failures. The predominant fail mode is to zero current. At zero input current, this servovalve provides a positive fail-fixed action. This same action occurs upon a negative hardover current signal which occurs much less often than a zero input current. A hardover positive current signal, which is expected to occur only as frequently as a negative hardover signal, causes the servopiston to stroke in a preselected direction. This combination of features will improve the reliability of many control systems.

From the foregoing description, it can be seen that the present invention comprises an improved fail-fixed servovalve which is compatible with pulse width modulated digital driving signals and which is relatively inexpensive to produce. It will be recognized by one skilled in the art that changes may be made to the above-described invention without departing from the broad inventive concepts thereof. For example, a flapper valve or diverter plate could be utilized instead of the jet pipe 12 and a pair of differing size balls or bellows could be substituted for the shuttle piston 40. In addition, the piston face area ratios of the shuttle piston 40 and/or the servopiston 54 could be varied to alter the effecting operating range of the servovalve. It is to be understood, therefore, that this invention is not limited to the particular embodiment disclosed, but it is intended to cover all modifications which are within the scope and spirit of the invention as set forth in the appended claims.

What is claimed is:

1. A fail-fixed electrohydraulic servovalve for use with a piston translatably disposed within a bore, the servovalve comprising means for maintaining the piston in a fixed position for electrical input signals which are less than a first predetermined percent of a maximum rated electrical input signal, for causing the piston to translate in a first direction for electrical input signals which are greater than said first percent but less than a second predetermined percent of said maximum rated electrical input signal, for maintaining the piston in a fixed position for electrical input signals which are equal to said second percent of said maximum rated electrical input signal, and for causing the piston to translate in the second direction for electrical input signals which are greater than said second percent of said maximum rated electrical input signal.

2. The servovalve as recited in claim 1 wherein said piston includes a rod side and a head side and the rod side of said piston has a piston face area which is less than the piston face area of the head side of said piston; and said second percent is determined by the ratio of the piston rod side face area to the piston head side face area.

3. The servovalve as recited in claim 2 wherein the rod side piston face area is substantially sixty percent of the head side piston face area and the predetermined percent is twenty-five percent.

* * * * *